United States Patent [19]

Ewald

[11] 4,325,497

[45] Apr. 20, 1982

[54] CHILD-RESISTANT SPRAY THROUGH COVER

[75] Inventor: Ronald F. Ewald, Rolling Meadows, Ill.

[73] Assignee: Knight Engineering & Molding Co., Arlington Heights, Ill.

[21] Appl. No.: 127,594

[22] Filed: Mar. 6, 1980

[51] Int. Cl.[3] ..... B65D 83/14; B67D 5/32

[52] U.S. Cl. ..... 222/153; 222/402.11

[58] Field of Search ..... 222/153, 182, 402.11, 222/402.13, 402.15

[56] References Cited

U.S. PATENT DOCUMENTS

| | | | |
|---|---|---|---|
| 3,738,537 | 6/1973 | Gach | 222/402.11 |
| 3,885,717 | 5/1975 | Ewald | 222/402.11 |
| 3,913,805 | 10/1975 | Sette | 222/402.15 |

*Primary Examiner*—H. Grant Skaggs

*Attorney, Agent, or Firm*—Kinzer, Plyer, Dorn & McEachran

[57] ABSTRACT

A child resistant spray through cover assembly for aerosol and similar containers. The cover assembly is adapted to be applied to a container having a conventional actuator button with a discharge outlet in which the actuator button discharges when it is moved axially toward the container. The cover assembly includes a housing which is adapted to fit over the actuator button and to be securely attached to the container. An opening is formed in the housing to allow the passage of spray discharge through the discharge outlet of the actuator button. A movable flap is mounted on the housing and extends over the actuator button. The flap is movable upon the application of force thereto by a finger of a user between a first position in which it is located out of actuating engagement with the actuator button and a second position in which it is in actuating engagement with the actuator button. A locking mechanism is provided to retain the flap in its first position. A finger engaging mechanism is provided for releasing the locking mechanism to permit the flap to be moved to its second position. A mechanism is provided on the flap for depressing the actuator button when the flap is moved to its second position. A spring arrangement is provided to return the flap to its first position and the locking mechanism to locking engagement with the flap when the application of force to the flap is discontinued so that the child resistant features of the cover assembly are automatically restored after use and without any active participation of the user.

14 Claims, 29 Drawing Figures

Fig. 23.
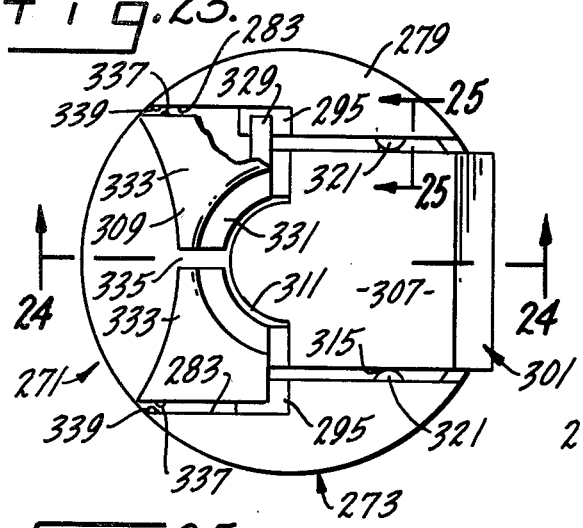
Fig. 24.
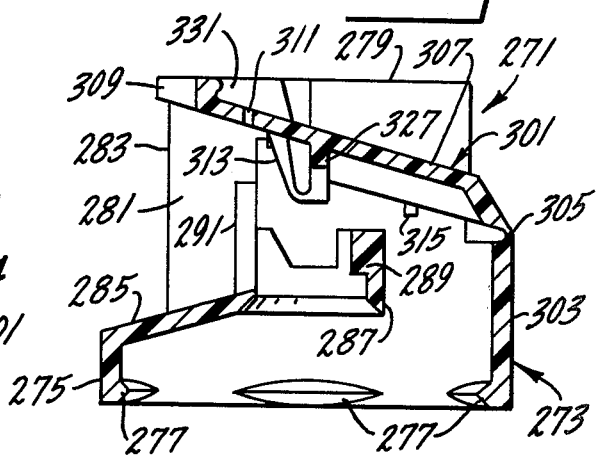
Fig. 25.
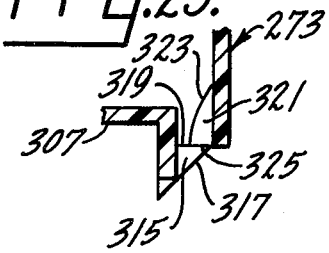
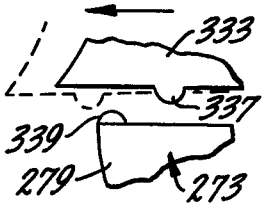
Fig. 26.
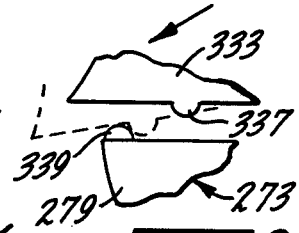
Fig. 27.
Fig. 28.
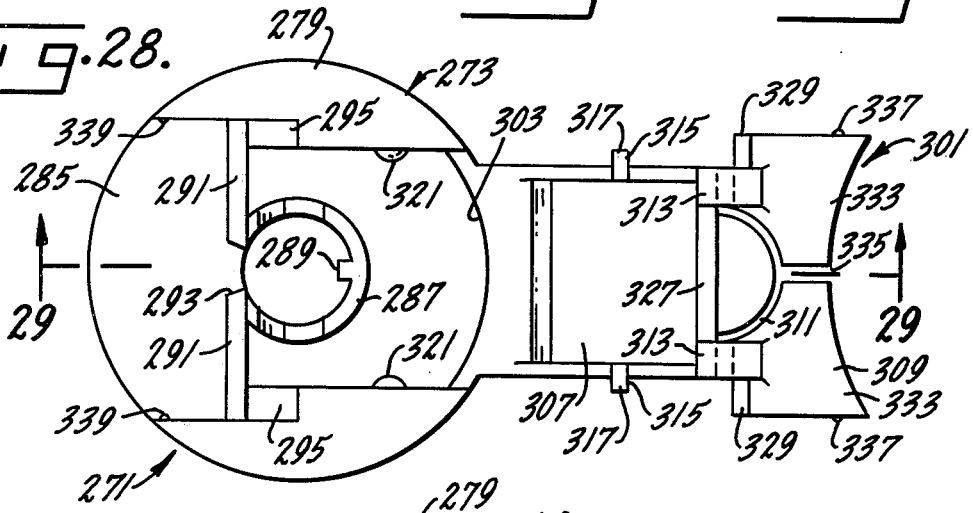
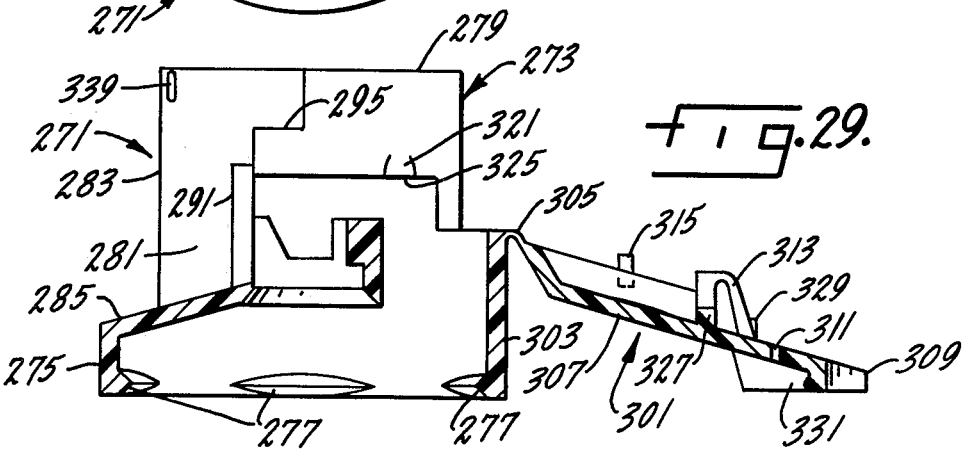
Fig. 29.

CHILD-RESISTANT SPRAY THROUGH COVER

SUMMARY OF THE INVENTION

This invention is directed to a child resistant spray through cover assembly for aerosol and similar containers and more particularly to a cover assembly which automatically resets in a child resistant condition after it is used.

An object of this invention is a child resistant spray through cover assembly which can be used with a aerosol container having a conventional actuator button without the necessity for extensive modification of the actuator button.

Another object of this invention is a child resistant spray through cover assembly having a actuator button flap which must be unlocked and then moved to an operating position before the actuator button is operated.

Another object of this invention is a child resistant spray through cover assembly for an aerosol container having locking means which must be simultaneously pushed sideways and a flap which must be slid forward in order to operate the aerosol actuator button.

Another object of this invention is a child resistant spray through cover assembly having pairs of release buttons which must be simultaneously depressed while an actuating flap is slid to an actuating position.

Another object of this invention is a child resistant spray through cover assembly which is molded in one piece.

Other objects may be found in the following specification, claims and drawings.

BRIEF DESCRIPTION OF THE DRAWINGS

The invention is illustrated more or less diagrammatically in the following drawings wherein:

FIG. 23 is a top plan view of still another modification of the cover assembly of this invention;

FIG. 24 is a cross sectional view taken along line 24—24 of FIG. 23;

FIG. 25 is an enlarged cross sectional view taken along line 25—25 of FIG. 23;

FIG. 26 is an enlarged partial view of a portion of the locking mechanism shown in an unlocked position in dashed lines;

FIG. 27 is an enlarged partial view of a locking mechanism showing a locked position in dashed lines;

FIG. 28 is a top plan view of the cover assembly of FIG. 23 with the flap in its open or molded position; and FIG. 29 is a cross sectional view taken along line 29—29 of FIG. 28.

DESCRIPTION OF THE PREFERRED EMBODIMENTS

Figure 1:
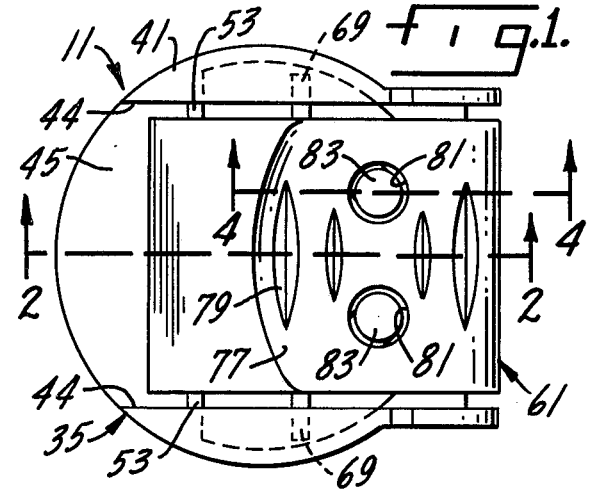
FIG. 1 is a top plan view of a first embodiment of a cover assembly of this invention.
Figure 2:
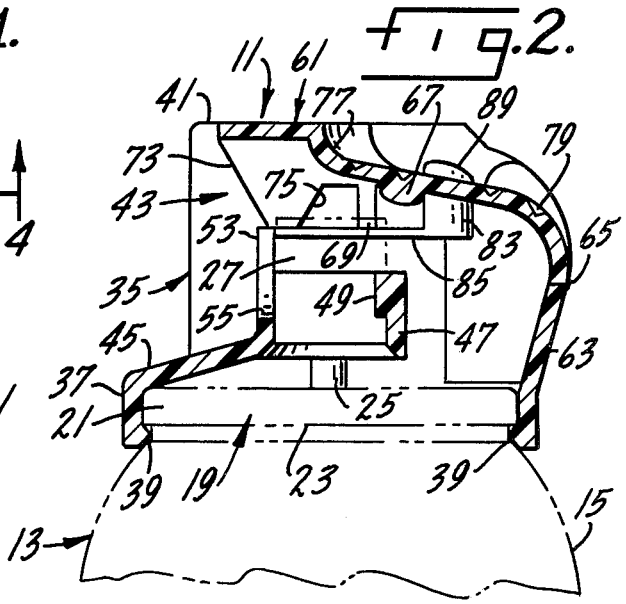
FIG. 2 is a cross sectional view taken along line 2—2 of FIG. 1 and showing an aerosol container at least partially in phantom.
Figure 3:
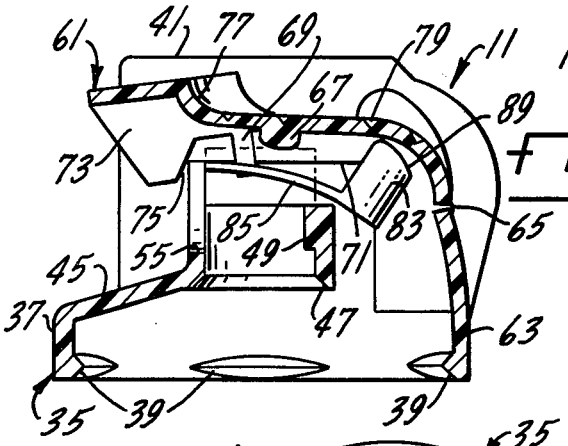
FIG. 3 is a cross sectional view similar to FIG. 2 but showing the cover assembly in its actuated position.
Figure 4:
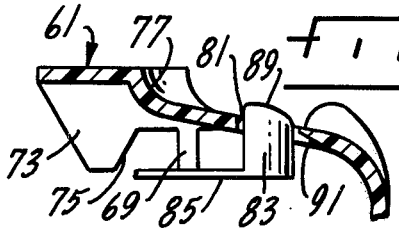
FIG. 4 is a partial cross sectional view taken along line 4—4 of FIG. 1.

FIGS. 1 through 6 of the drawings show one embodiment of this invention in the form of a spray through child resistant cover assembly 11 which is adapted to be mounted on the top of a cylindrical aerosol container 13. As is conventional, the aerosol container has a domed top 15 which is attached to the main body of the container by an upstanding seam. A valve mounting cup 19 is attached to the domed top and includes a downwardly turned collar 21 which terminates in an undersurface 23. A valve stem 25 extends axially upwardly through the valve mounting cup 19 and is connected to a valve (not shown) which is located under the valve mounting cup. An actuator button 27 is mounted on the top of the valve stem 25 and has a discharge outlet. As is conventional, axial movement of the actuator button 27 towards the container 13, or, in other words, depression of the actuator button, will discharge the contents of the aerosol container through the discharge outlet.

The cover assembly 11 of this invention includes a housing 35 which may be injection molded of any suitable thermoplastic material including, but not limited to, such materials as polyethylene, polypropylene and the like. The housing 35 includes an outer wall 37 which surrounds the valve mounting cup 19 and actuator button 27 and engages the collar 21 of the valve mounting cup. The engagement with the collar is accomplished by inwardly projecting segmented lips 39 molded inegrally with the housing and located at the lower open end of the housing. When the housing is installed on an aerosol container, the segmented lips 39 fit under and engage the undersurface 23 of the collar 21 of the valve mounting cup.

The upper portion of the housing 35 is closed by a top wall 41 which merges with the outer wall 37. A diametrically extending valley 43 divides the top wall 41 into two segments. The valley has interior side walls 44 and is open at the front and rear of the housing. At the front of the housing, a downwardly sloping wall 45 forms the floor of the valley. A sleeve 47 is cantileverly supported on this wall and this sleeve fits over and around the actuator button 27. An inwardly projecting, vertically extending key 49, which is formed integrally with the sleeve 47, fits in a keyway (not shown) formed in the actuator button 27. The engagement of the key and the keyway aligns the actuator button with the cover assembly. Upstanding walls 53 formed on the sloping wall 45 and extending inwardly from the side walls 44 of the valley 43 terminate short of each other to form a discharge passage 55 which aligns with the discharge outlet of the actuator button 27.

A flap 61 is formed integrally with the cover assembly 11 and is connected to the rear wall 63 of the cover assembly by a living hinge 65. The rear wall is formed with a built-in rearwardly extending bow to provide this wall with a spring action. An actuator button engaging boss 67 is formed integrally with the underside of the flap 61. Laterally extending fingers 69 are formed in the side edges of the flap and engage an overhang 71 formed in the valley side walls 44 of the cover assembly. The fingers engage the overhang 71 to maintain the flap in its folded position shown in FIGS. 1 through 4 of the drawings in which the flap extends over and prevents access to the actuator button 27 of the aerosol container. Lugs 73 are formed on opposite sides of the flap at the front end thereof. The lugs extend downwardly to rest on top of the walls 53 when the flap is in its non-actuating position shown in FIG. 2. Each lug 73 is formed with an inclined rearward edge 75. A finger abutment 77 is formed on the top of the flap to facilitate the application of force to the flap without slippage of the finger of the user. For the same reason, gripping depressions 79 are formed in the top surface of the flap immediately behind the finger abutment. A pair of spaced apertures 81 extend through the top flap 61. These apertures align with and receive detents 83 formed at the free ends of spring arms 85 which are connected to the walls 53 of the cover assembly.

Each detent 83 is generally cylindrical and has a top surface 89 which extends above the flap 61 when a detent 83 is received in an aperture 81. The top surface 89 slopes rearwardly and a corresponding rearwardly extending incline 91 (shown in FIG. 4) is formed in the undersurface of the flap at the rear of each aperture.

Figure 5:
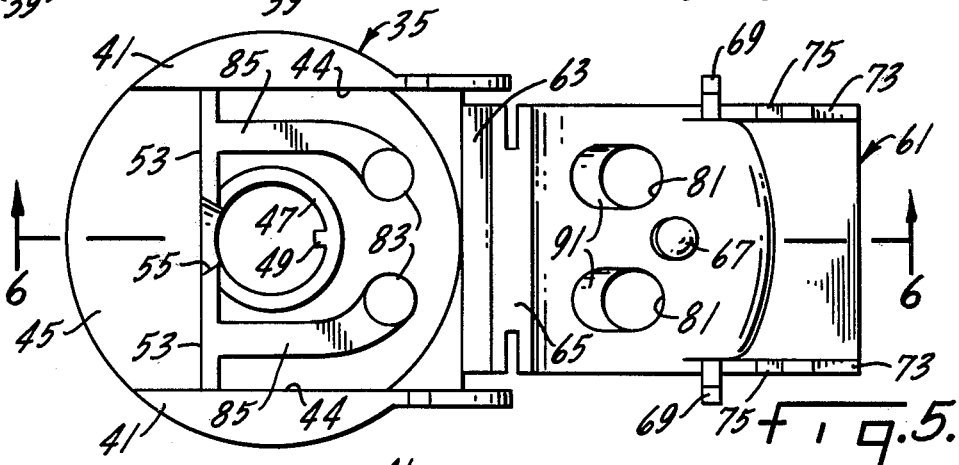
FIG. 5 is a top plan view of a cover assembly showing the flap in its open or molded position.
Figure 6:
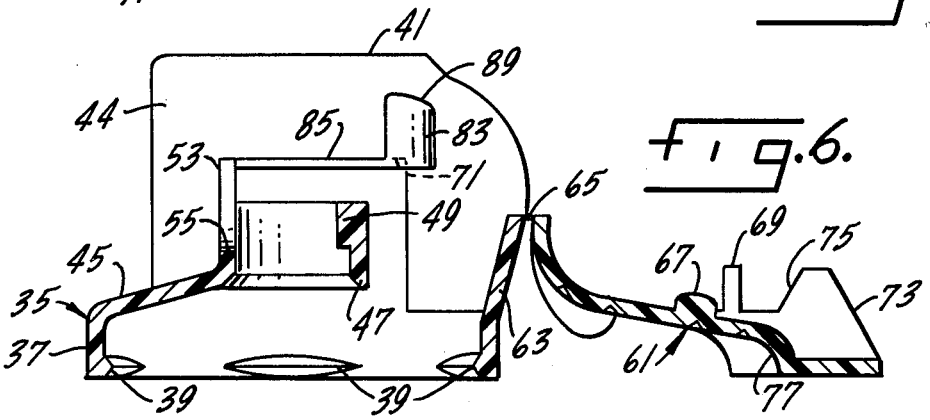
FIG. 6 is a cross sectional view taken along line 6—6 of FIG. 5.
Figure 7:
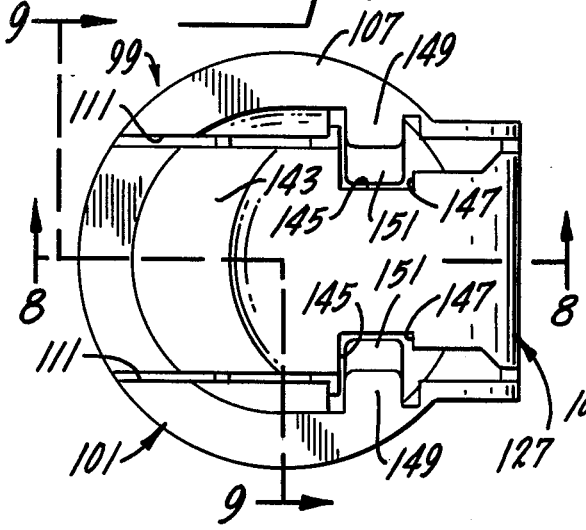
FIG. 7 is a top plan view of a modified form of cover assembly.
Figure 8:
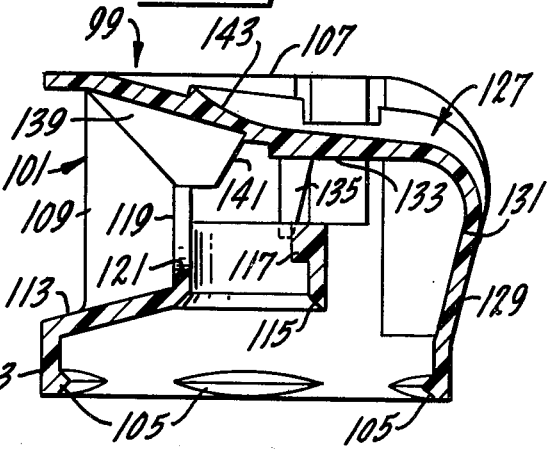
FIG. 8 is a cross sectional view taken along line 8—8 of FIG. 7.
Figure 9:
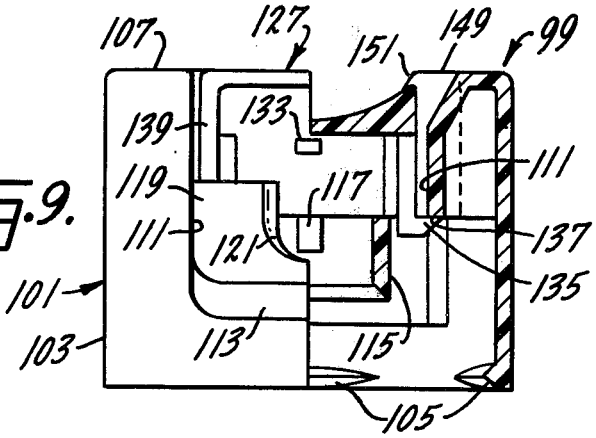
FIG. 9 is a cross sectional view taken along line 9—9 of FIG. 7.

The flap and cover assembly are molded with the flap in its outwardly extending or unfolded position as shown in FIGS. 5 and 6 of the drawings. When the cover is assembled prior to installation on an aerosol container, the flap is folded to the position shown in FIGS. 1 and 2 of the drawings which is the locked or non-actuated position of the flap. In this position of the flap, the actuator button engaging boss 67 is out of contact with the actuator button 27 of the aerosol container. Also, the flap is locked against forward or sliding movement by engagement of the detents 83 of the spring arms 85 with the portions of the flap surrounding the aperture openings 81. When the flap is folded to its assembled position, the fingers 69 snap under the overhang 71 to secure the flap against return to its extended or unfolded position.

To operate the actuator button 27 of the aerosol container it is necessary for a user to engage and depress both detents 83 and at the same time, slide the flap 61 forward to its actuating position. A concerted manipulation of this type is difficult, if not impossible, for a young child because the child's finger is generally not wide enough to depress both detents at the same time. Further, a young child usually does not have sufficient strength in his finger to depress both detents and simultaneously exert a sliding force against the finger abutment 77.

When the detents 83 are both depressed and the flap moved forward, the sloping tops 89 of the detents will slide under the inclined undersurfaces 91 of the flap to depress and bend the spring arms 85. Continued forward and downward motion applied to the flap 61 will push the lugs 73 beyond the discharge passage walls 53 to permit the boss 67 to engage and depress the actuator button 27. Forward motion of the flap will be resisted by the spring bias of the housing rear wall 63 so that upon release of actuating force to the flap, the spring bias applied by the rear wall 63 and by the spring arms 85 will return the flap to its original position and return the detents 83 into engagement with the apertures 81 in the flap to again lock the flap in its non-actuating position.

A modified embodiment of the invention is found in the cover assembly 99 depicted in FIGS. 7 through 11 of the drawings. In this depiction, only the cover assembly is shown and the conventional parts of the aerosol container which were shown and described in connection with the embodiment of FIGS. 1 through 6 have been omitted for brevity and clarity of illustration.

The cover assembly 99 includes a molded plastic housing 101. The housing includes an outer wall 103 which surrounds the valve mounting cup and actuator button and engages the collar of the valve mounting cup when the housing is installed on aerosol container. The engagement with the collar is accomplished by inwardly projecting segmented lips 105 molded integrally with the housing and located at the lower open end of the housing. When the housing is installed on an aerosol container, the segmented lips 105 fit under and engage the undersurface of the collar of the valve mounting cup.

The upper portion of the housing 101 is closed by a top wall 107 which merges with the outer wall 103. A diametrically extending valley 109 divides the top wall 107 into two segments. The valley has interior side walls 111 and is open at the front and rear of the housing. At the front of the housing, a downwardly sloping wall 113 forms the floor of the valley. A sleeve 115 is cantileverly supported on this wall and this sleeve fits over and around the actuator button of the aerosol container. An inwardly projecting vertically extending key 117, which is formed integrally with the sleeve 115, fits into a keyway (not shown) formed in the actuator button. The engagement of the key and the keyway aligns the actuator button with the cover assembly. Upstanding walls 119 formed on the sloping wall 113 and extending inwardly from the side walls 111 of the valley 109 terminate short of each other to form a discharge passage 121 which aligns with the discharge outlet of the actuator button.

A flap 127 is formed integrally with the cover assembly 99 and is connected to the rear wall 129 of the cover assembly by a living hinge 131. The rear wall is formed with a built-in rearwardly extending bow to provide this wall with a spring action. An actuator button engaging boss 133 is formed integrally with the underside of the flap 127. Laterally extending fingers 135 are formed on the side edges of the flap and engage an overhang 137 formed in the valley side walls 111 of the cover assembly. The fingers engage the overhang 137 to maintain the flap in its folded position shown in FIGS. 7, 8 and 9 of the drawings in which the flap extends over and prevents access to the actuator button of the aerosol container. Lugs 139 are formed on opposite sides of the flap at the front end thereof. The lugs extend downwardly to rest on top of the walls 119 when the flap is in its non-actuating position shown in FIGS. 7, 8 and 9 of the drawings. Each lug 139 is formed with an inclined rearward edge 141. A finger abutment 143 is formed on the top of the flap to facilitate the application of force to the flap without slippage of the finger of the user.

Notches 145 are formed on opposite edges of the flap 127 near the rear portion thereof. Each notch has a rear edge 147 which engages detent 149 formed integrally with the housing 101 and hinge thereto near the tops of the detents so that the detents can be pushed outwardly and out of engagement with the notches 145. Each detent has an inside inclined surface 151 which is engageable by a user's finger.

Figure 10:
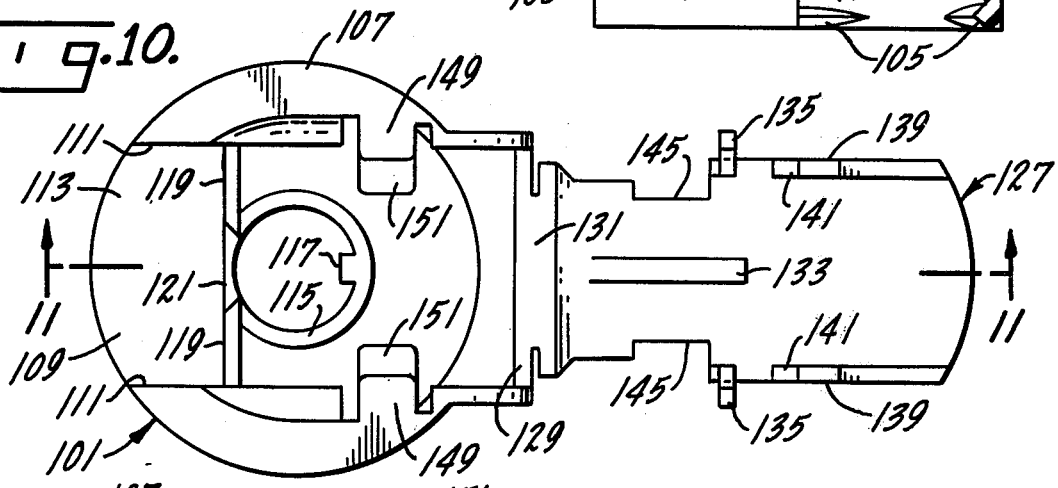
FIG. 10 is a top plan view of the cover assembly of FIG. 7 with the flap in its open or molded position.
Figure 11:
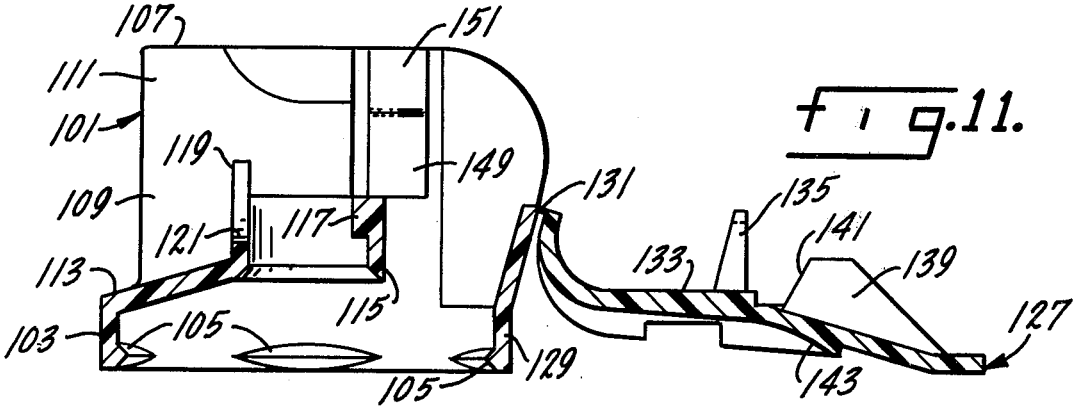
FIG. 11 is a cross sectional view taken along line 11—11 of FIG. 10.
Figure 12:
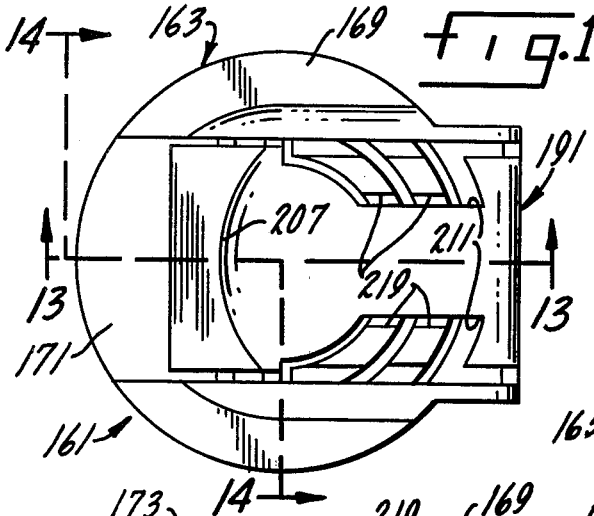
FIG. 12 is a top plan view of yet another modified form of cover assembly of this invention.
Figure 13:
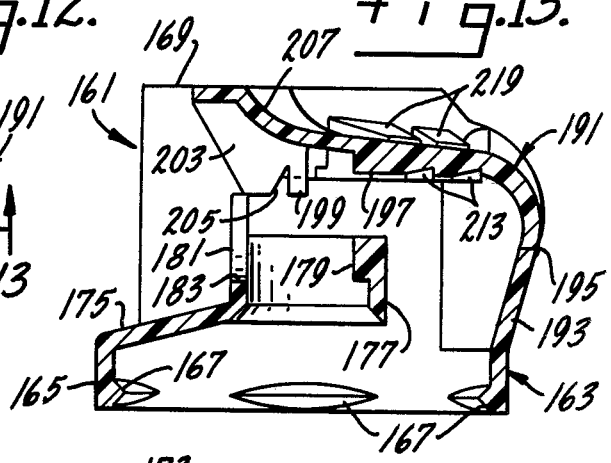
FIG. 13 is a cross sectional view taken along line 13—13 of FIG. 12.

The flap and cover assembly are molded with the flap in its outwardly extending or unfolded position as shown in FIGS. 10 and 11 of the drawings. When the cover assembly is assembled prior to installation on an aerosol conner, the flap is folded to the positions shown in FIGS. 7, 8 and 9 of the drawings which is the locked or non-actuated position of the flap. In this position of the flap, the actuator button engaging boss 133 is out of contact with the actuator button of the aerosol container. Also, the flap is locked against forward or sliding movement by engagement of the detents 149 with the rear edges 147 of the notches 145. When the flap is folded to its assembled position, the fingers 135 snap under the overhang 137 in the manner shown in FIG. 9 of the drawings to secure the flap against return to its extended or unfolded position.

To operate the actuator button of the aerosol container, it is necessary for a user to engage and push apart both detents 149 until they clear the rear edges 147 of the notches 145 in the flap, and at the same time, slide the flap 127 forward to its actuating position. A concerted manipulation of this type is difficult, if not impossible, for a young child because a child's finger is generally not wide enough to engage and spread apart both detents at the same time. Further, a young child usually does not have sufficient strength in his finger to spread apart both detents and simultaneously exert a sliding force against the finger abutment 143 of the flap.

Continued forward and downward motion applied to the flap 127 will push the lugs 139 beyond the discharge passage walls 119 to permit the boss 133 to engage and depress the actuator button of the aerosol container. Forward motion of the flap will be resisted by the spring bias of the housing rear wall 129 so that upon release of actuating force to the flap, the spring bias by the rear wall 129 will return the flap to its original position where the detents 149 will move back into the notches 145 to again lock the flap in its non-actuating position.

Another modified embodiment of the invention is found in the cover assembly 161 depicted in FIGS. 12 through 15 of the drawings. In this depiction, only the cover assembly is shown and the conventional parts of the aerosol container which were shown and described in connection with the embodiment of FIGS. 1 through 6 have been omitted for brevity and clarity of illustration.

The cover assembly 161 includes a molded plastic housing 163. The housing includes an outer wall 165 which surrounds the valve mounting cup and actuator button and engages the collar of the valve mounting cup when the housing is installed on an aerosol container. Engagement with the collar is accomplished by inwardly projecting segmented lips 167 molded integrally with the housing and located at the lower open end of the housing. When the housing is installed on an aerosol container, the segmented lips 167 fit under and engage the undersurface of the collar of the valve mounting cup.

The upper portion of the housing 163 is closed by a top wall 169 which merges with the outer wall 165. A diametrically extending valley 171 divides the top wall 169 into two segments. The valley has interior side walls 173 and is open at the front and rear of the housing. At the front of the housing, a downwardly sloping wall 175 forms the floor of the valley. A sleeve 177 is cantileverly supported on this wall and this sleeve fits over and around the actuator button of the aerosol container. An inwardly projecting vertically extending key 179 fits into a keyway (not shown) formed in the actuator button. The engagement of the key and the keyway aligns the actuator button with the cover assembly. Upstanding walls 181 formed on the sloping wall 175 and extending inwardly from the side walls 173 of the valley 171 terminate short of each other to form a discharge passage 183 which aligns with the discharge outlet of the actuator button.

A flap 191 is formed integrally with the cover assembly 161 and is connected to the rear wall 193 of the cover assembly by living hinge 195. The rear wall is formed with a built-in rearwardly extending bow to provide this wall with a spring action. An actuator button engaging boss 197 is formed integrally with the underside of the flap 191. Laterally extending fingers 199 are formed on the side edges of the flap and engage an overhang 201 formed in the valley side walls 173 of the cover assembly. The fingers engage the overhang 201 to maintain the flap in its folded position shown in FIGS. 12, 13 and 14 of the drawings in which the flap extends over and prevents access to the actuator button of the aerosol container. The fingers are formed immediately adjacent lugs 203 at the front end of the flap. The lugs extend downwardly to rest on top of the walls 181 when the flap is in its non-actuating position shown in FIGS. 12, 13 and 14 of the drawings. Each lug is formed with an inclined rearward edge 205. A finger abutment 207 is formed on the top of the flap to facilitate the application of force to the flap without slippage of the finger of the user.

Cutaway portions 211 are formed on opposite sides of the flap 191 near the rear portion thereof. Wedge shaped detents 213 are formed on the inner ends of the spring arms 215 which extend from the side walls 173 of the housing. In this embodiment there are two spring arms 215 on each side of the housing. Each detent has an end wall 217. Each spring wall includes a button 219 having sloped top walls 221 which extend through the cutaway portions 211 above the top surface of the flap. The wedge shaped detents engage complementary notches 223 formed in the undersurface of the flap and notch walls 225 engage the detent walls 217 to limit movement of the flap relative to the housing.

Figure 17:
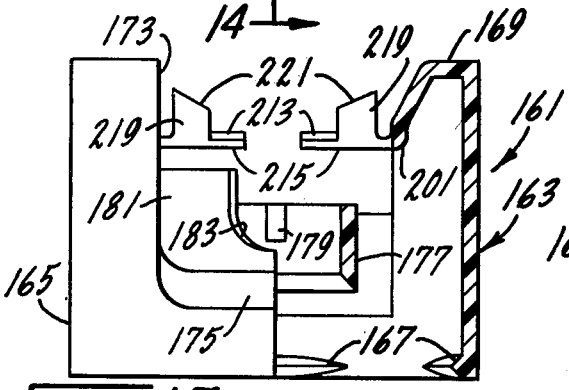
FIG. 17 is a cross sectional view taken along line 17—17 of FIG. 15.
Figure 14:
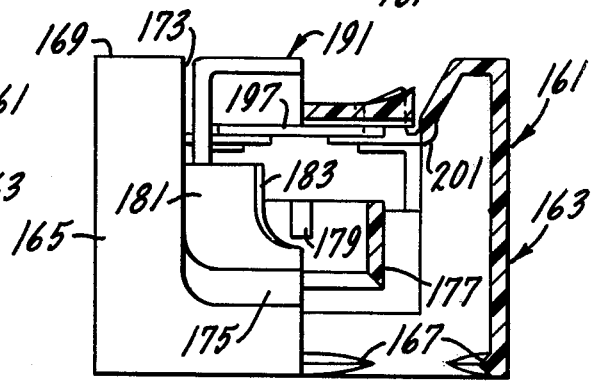
FIG. 14 is a cross sectional view taken along line 14—14 of FIG. 12.
Figure 16:
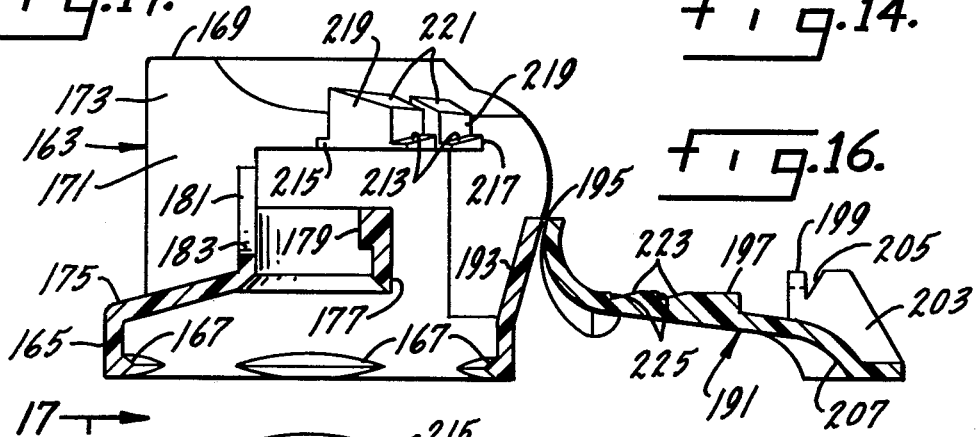
FIG. 16 is a cross sectional view taken along line 16—16 of FIG. 15.
Figure 15:
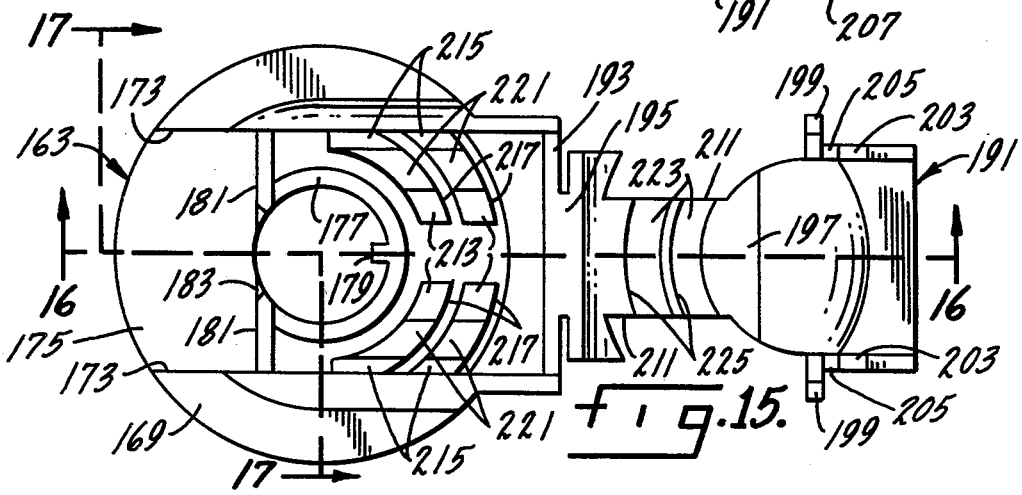
FIG. 15 is a top plan view of the cover of FIG. 12 with the flap in its open or molded position.

The flap and cover assembly are molded with the flap in its outwardly extending or unfolded position as shown in FIGS. 15, 16 and 17 of the drawings. When the cover assembly is assembled prior to installation on an aerosol container, the flap is folded to the position shown in FIGS. 12, 13 and 14 of the drawings which is the locked or non-actuated position of the flap. In this position of the flap, the actuator button engaging boss 197 is out of contact with the actuator button of the aerosol container. Also, the flap is locked against forward or sliding movement by engagement of the detent walls 217 with the notch walls 225 of the notches formed in the underside of the flap. When the flap is folded to its assembled position, the fingers 199 snap under the overhang 201 in the manner shown in FIG. 13 of the drawings to secure the flap against return to its extended or unfolded position.

To operate the actuator button of the aerosol container, it is necessary for a user to engage the sloped top surfaces 221 on all four buttons 219 and to depress these buttons until the detent walls 217 clear the notch walls 225 on the underside of the flap, and at the same time, slide the flap 191 forward to its actuating position. A concerted manipulation of this type is difficult, if not impossible, for a young child because a child's finger is generally not wide enough to engage and depress all four buttons 219 and simultaneously exert a sliding force against the finger abutment 207 of the flap.

Continued forward and downward motion applied to the flap 191 will push the lugs 203 beyond the discharge passage walls 181 to permit the boss 197 to engage and depress the actuator button of the aerosol container. Forward motion of the flap will be resisted by the spring bias of the housing rear wall 193 and the spring arms 215 so that upon release of actuating force to the flap, the spring bias of these members will return the flap to its original position where the walls 217 of the detents will move back into the notches 223 of the flap to again lock the flap in its non-actuating position.

Figure 18:
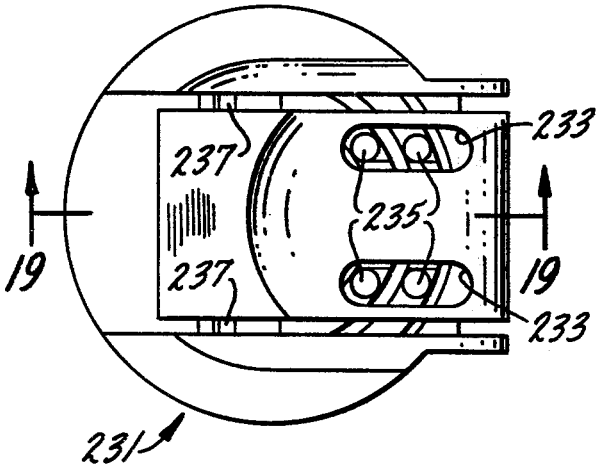
FIG. 18 is a top plan view of still another modified form of cover assembly.
Figure 19:
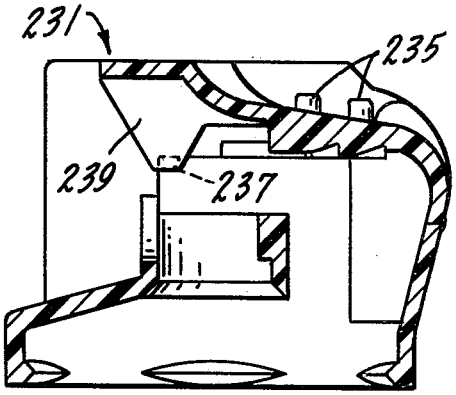
FIG. 19 is a cross sectional view taken along line 19—19 of FIG. 18.

A variation of the cover assembly 161 of FIGS. 12 through 17 of the drawings is shown in cover assembly 231 depicted in FIGS. 18 and 19 of the drawings. Only the parts of the cover assembly 231 which are different than those previously shown and described in the embodiment of FIGS. 12 through 17 will be specifically referred to for brevity and clarity of illustration. In this variation of the invention, the longitudinally extending notches 211 are replaced by elongated slots 233. The spring arm buttons 219 are replaced by cylindrical buttons 235 which extend through the elongated slots 233. The fingers 199 are replaced by fingers 237 extending from the lugs 239. In all other respects, the construction and functioning of the cover assembly 231 is similar to the construction and functioning of the cover assembly 161 previously described.

Figure 20:
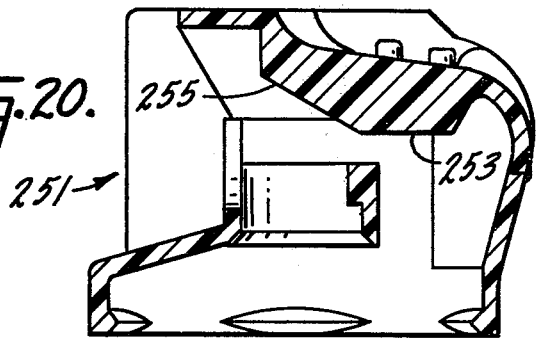
FIG. 20 is a cross sectional view of still another modified form of cover assembly of this invention.
Figure 21:
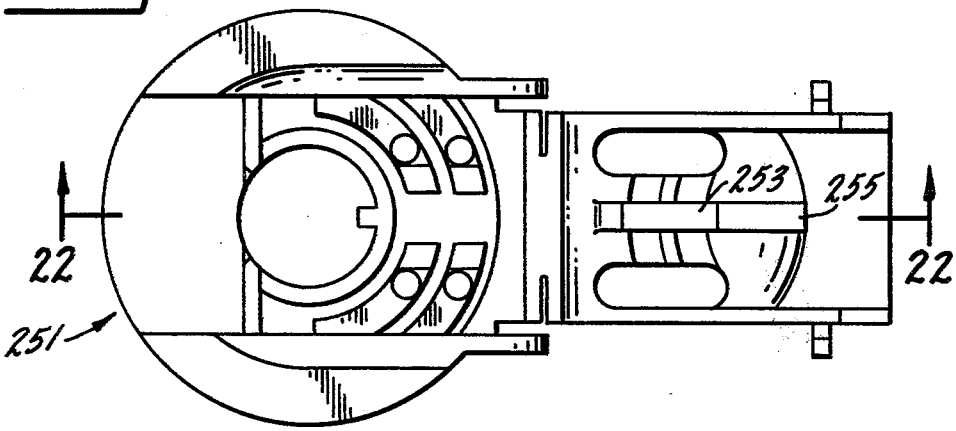
FIG. 21 is a top plan view of the cover of FIG. 20 with the flap in its open or molded position.
Figure 22:
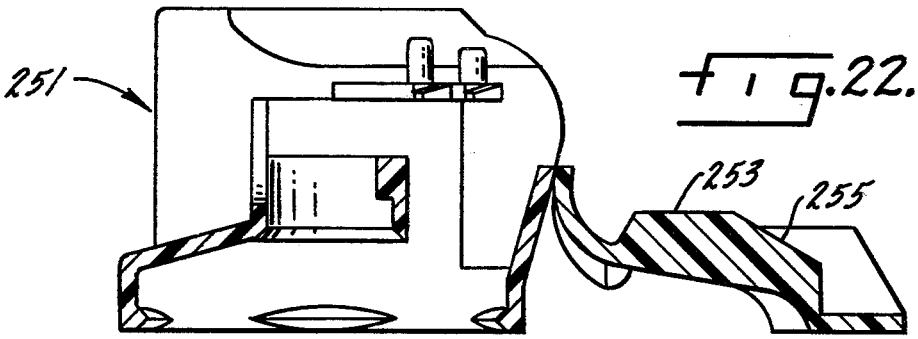
FIG. 22 is a cross sectional view taken along line 22—22 of FIG. 21.

A modification of the variation of the cover assembly shown in FIGS. 18 and 19 is shown in the cover assembly 251 of FIGS. 20, 21 and 22. In this embodiment, the actuator button boss 197 is replaced by a boss 253 having a sloping front surface 255 which permits the actuator button to be operated simply by forward sliding motion of the flap 191. In all other aspects, the cover assembly 251 is similar to the cover assembly 231 of FIGS. 18 and 19.

FIGS. 23 through 29 of the drawings show another embodiment of this invention in a form of a spray through child resistant cover assembly 271 which is adapted to be mounted on the top of a cylindrical aerosol container. As is conventional, the aerosol container has a domed top which is attached to the main body of the container by an upstanding seam. A valve mounting cup is attached to the domed top and includes a downwardly turned collar which terminates in an undersurface. A valve stem extends axially upwardly through the valve mounting cup and is connected to a valve which is located under the valve mounting cup. An actuator button is mounted on the top of the valve stem and has a discharge outlet. Axial movement of the actuator button towards the container or, in other words, depression of the actuator button will discharge the contents of the aerosol container through the discharge outlet. Since such an aerosol container is conventional and well known, it is not shown and described herein.

The cover assembly 271 of this invention includes a housing 273 which may be injection molded of any suitable thermoplastic material including, but not limited to, such materials as polyethylene, polypropylene and the like. The housing 273 includes an outer wall 275 which surrounds the valve mounting cup and actuator button of the aerosol container and engages the collar of the valve mounting cup. The engagement with the collar is accomplished by inwardly projecting segmented lips 277 molded integrally with the housing and located at the lower open end of the housing. When the housing is installed on an aerosol container, the segmented lips 277 fit under and engage the undersurface of the collar of the valve mounting cup.

The upper portion of the housing is closed by a top wall 279 which merges with the outer wall 275. A diametrically extending valley 281 divides the top wall 279 into two segments. The valley has interior side walls 283 and is open at the front and rear of the housing. At the front of the housing, a downwardly sloping wall 285 forms the floor of the valley. A sleeve 287 is cantileverly supported on this wall and this sleeve fits over and around the actuator button of the aerosol container. An inwardly projecting, vertically extending key 289, which is formed integrally with the sleeve 287, fits into a keyway formed in the actuator button. The engagement of the key in the keyway aligns the actuator button with the cover assembly. Upstanding walls 291 formed on the sloping wall 285 and extending inwardly from the side walls 283 of the valley 281 terminate short of each other to form a discharge passage 293 which aligns with the discharge outlet of the actuator button. Ledges 295 are formed on the side walls 283 and are located rearwardly of the walls 291.

A flap 301 is formed integrally with the cover assembly 271 and is connected to the rear wall 303 of the cover assembly by a living hinge 305. The flap is divided into a rear portion 307 and a front portion 309 by an arcuate slot 311. The front and rear portions of the flap are connected only by a pair of U-shaped hinges 313 located on opposite lateral sides of the flap. Laterally extending projections 315, shown in enlarged detail in FIG. 25, are formed on the rear portion 307 of the flap on opposite sides thereof. Each projection has a sloping undersurface 317 and a flat upper surface 319. These projections engage projections 321 formed on opposite sides of the housing 273. The housing projections have arcuate upper surfaces 323 and flat undersurfaces 325 so that the projections on the flap can be slid over the projections on the housing when the flap is folded into position on the housing but cannot be readily removed.

An actuator button bar 327 extends transversely across the rear portion of the flap and is adapted to engage the actuator button on the aerosol container. Lugs 329 are located on opposite sides of the front portion of the flap and rest on the ledges 295 formed in the side walls 283 of the housing. A finger engaging abutment 331 is formed integrally with the front portion 309 of the flap. In this embodiment, the flap front portion 309 is divided into right and left hand segments 333 by a slot 335. Each segment 333 is joined to the rear portion 307 of the flap by one of the U-shaped hinges 313.

Semicylindrical protuberances 337 are formed on the opposite side edges of the front flap segments 333 and these protuberances are positioned near semicylindrical protuberances 339 formed on the side walls 283 of the housing 273. The distances between the protuberances on the flap segments and on the side walls of the container are less than the distance a lug 329 must be moved to be slid off a ledge 295.

The flap 301 and cover assembly 271 are molded with the flap in its outwardly extending or unfolded position as shown in FIGS. 28 and 29 of the drawings. When the cover is assembled prior to installation on an aerosol container, the flap is folded to the position shown in FIGS. 23 and 24 of the drawings which is the locked or non-actuated position of the flap. In the locked position of the flap, the actuator button engaging bar 327 is out of contact with the actuator button of the aerosol container. Also, the flap is locked against downward movement toward the aerosol container by engagement of the lugs 329 with the ledges 295 of the housing. When the flap is folded to the assembled position shown in FIGS. 23 and 24 of the drawings, the projections 315 on the flap engage and lock with the projections 321 on the housing to secure the flap against return to its extended or unfolded position.

To operate the actuator button of the aerosol container, it is necessary for a user to slide both of the front flap segments 333 in a forward direction so that the lugs 329 move off the ledges 295 and drop to the tops of the front walls 291. When the lugs have so dropped, the rear portion 307 of the flap can be depressed so that the actuator button bar 327 engages the actuator button of the aerosol container.

In order to move the lugs 329 off the ledges 295, it is necessary to slide both segments 333 of the front portion 309 of the flap forward in such a manner that the semicylindrical protuberances 337 clear the similar protuberances 339 formed on the housing. This requires that both segments be moved forward without appreciable lateral movement. A young child does not have the strength and dexterity to slide both of the flap segments 333 forward in the manner shown in FIG. 26 but instead is likely to apply lateral forces to one segment or the other of the front portion of the flap so that one protuberance engages another as shown in FIG. 27 and thus prevent unlocking and movement of the front portion of the flap 301. Forward motion of the front flap segments 333 is resisted by the resiliency of the U-shaped hinges 313 so that upon release of actuating force to the segments 333 of the flaps and to the rear portion 307 of the flap, the lugs 329 will be returned to their locked position on top of the ledges 295.

I claim:

1. A child-resistant spray through cover for aerosol and similar containers which cover assembly can be applied to a container having a conventional actuator button of the type in which the actuator button discharges through an outlet when the button is depressed, said cover assembly including:

a housing adapted to fit over the actuator button and to be securely attached to the container, an opening formed in the housing to allow the passage of spray discharged through the discharge outlet of the actuator button, a flap mounted on the housing and extending over the actuator button with the flap being movable across the actuator button upon the application of force applied thereto by a finger of a user between a first position and a second position, the flap being positioned out of actuating engagement with the actuator button when located in the first position and being positioned in actuating engagement with the actuator button in the second position, means operative when the flap is in the first position and inoperative when the flap is in the second position to prevent vertical movement of the flap into actuating engagement with the actuator button, locking means associated with the flap to restrain the flap in its first position, finger engaging means for releasing the locking means to permit the flap to be moved to its second position, and biasing means to return the flap to its first position and the locking means to its flap retaining association when the application of force to the flap is discontinued.

2. The cover assembly in claim 1 in which the flap is hingedly connected to the housing at the rear portion thereof.

3. The cover assembly of claim 2 in which the biasing means for returning the flap to its first position is formed as part of the wall of said housing and the flap is hingedly connected to the biasing means.

4. The cover assembly of claim 1 in which the locking means includes at least one cantilevered spring connected to the housing, a detent formed on the spring and a detent engaging surface formed on the flap.

5. The cover assembly of claim 4 in which the finger engageable means for releasing the locking means includes a pair of members spaced apart a predetermined distance and arranged so that both members must be engaged and moved to release the detent from the detent engaging surface.

6. The cover assembly of claim 4 in which the detent is mounted to move in a direction extending at right angles to the direction of movement of the flap, the detent engaging surface is formed in the edge of the flap and the finger engaging means for releasing the detent is arranged to be moved downwardly and outwardly to unlock the flap.

7. The cover assembly of claim 4 in which the spring and detent are mounted for movement towards and away from the undersurface of the flap, the detent engaging surface is formed on the undersurface of the flap and the finger engaging means for releasing the detent is arranged to be moved downwardly to unlock the flap.

8. The cover assembly of claim 7 in which said detent is a tooth and the detent engaging surface is part of a complementary tooth receiving socket.

9. The cover assembly of claim 5 in which the finger engageable means for releasing the locking means includes a sloped surface formed on top of the detent and a complementary sloped surface formed on the underside of the flap adjacent the detent engaging surface.

10. The cover assembly of claim 9 in which a pair of cantilevered springs are connected to the housing with the springs located so that the finger engageable surfaces are spaced apart a predetermined distance.

11. The cover assembly of claim 1 in which means are provided for moving the actuator button depressing means on the flap in an axial direction towards the actuator button as the flap is moved between the first and second positions.

12. The cover assembly of claim 1 in which said actuator button depressing means has an inclined surface which engages the actuator button as the flap moves from its first to its second position.

13. The cover assembly of claim 1 in which said locking means includes ledges formed on said housing and lugs formed on said flap, said lugs engaging said ledges to prevent axial movement of the flap towards the actuator button, said lugs being hingedly connected to the flap to permit them to be moved from the ledges and axially towards the actuator button to permit axial movement of the flap towards the actuator button.

14. The cover assembly of claim 13 in which said flap is divided into a front portion and a rear portion connected by elastic spring means, the means for depressing the actuator button is located on the rear portion of the flap and the ledge engaging lugs are positioned on the forward portion of the flap, the forward portion of the flap is divided laterally into right and left hand segments, both segments of which must be slid forward to release the locking lugs from the ledges and protuberances are formed on the edges of the right and left hand segments of the front portion and on the housing to prevent forward movement of the right and left hand segments relative to the housing unless both segments are moved forward by the finger of the user without substantial lateral movement.

* * * * *